United States Patent [19]

Mills

[11] Patent Number: 4,944,257

[45] Date of Patent: Jul. 31, 1990

[54] COLD-FORMED ROCKER ARM WITH BEARING FLANGES AND SPLASH PLATE

[75] Inventor: Jesse V. Mills, Toledo, Ohio

[73] Assignee: Henley Manufacturing Holding Company, Inc., Hampton, N.H.

[21] Appl. No.: 413,229

[22] Filed: Sep. 27, 1989

[51] Int. Cl.[5] ..... F01L 1/18

[52] U.S. Cl. ..... 123/90.34; 123/90.41

[58] Field of Search ..... 123/90.39, 90.41, 90.42, 123/90.47

[56] References Cited

U.S. PATENT DOCUMENTS

| | | | |
|---|---|---|---|
| 3,150,648 | 9/1964 | Gropp | 123/90.39 |
| 3,198,183 | 8/1965 | Ball | 123/90.42 |
| 3,270,727 | 9/1966 | Nance | 123/90.34 |
| 3,289,657 | 12/1966 | Winter, Jr. | 123/90.41 |
| 3,621,823 | 11/1971 | Lombardi | 123/90.42 |
| 3,667,434 | 6/1972 | Sandusky | 123/90.41 |
| 4,314,732 | 2/1982 | Murphy | 123/90.41 |
| 4,380,219 | 4/1983 | Walsh | 123/90.41 |
| 4,440,121 | 4/1984 | Clancy et al. | 123/90.39 |
| 4,784,095 | 11/1988 | Golding et al. | 123/90.41 |
| 4,799,464 | 1/1989 | Patel et al. | 123/90.41 |

*Primary Examiner*—David A. Okonsky
*Assistant Examiner*—Weilun Lo
*Attorney, Agent, or Firm*—Allen D. Gutchess, Jr.

[57] ABSTRACT

A cold-formed, specifically stamped, rocker arm is disclosed. The rocker arm has a one-piece metal body of generally inverted U-shaped cross section throughout most of its length. The body has a top wall and two generally parallel side walls which extend downwardly therefrom and are structurally integral therewith. The side walls have annular extruded flanges extnding outwardly therefrom and forming aligned bores to receive bearings. The rocker arm body has a recess at one end to engage an end of a push rod and a surface at the other end to engage an end of a valve stem. The top wall of the rocker arm body has a splash plate extending upwardly therefrom and the wall also has a port communicating with the recess to direct oil at the splash plate which is then dispersed and more widely distributed by the plate.

19 Claims, 2 Drawing Sheets

COLD-FORMED ROCKER ARM WITH BEARING FLANGES AND SPLASH PLATE

This invention relates to a cold-formed, stamped rocker arm having annular flanges extending outwardly to receive bearings and having an oil splash plate extending upwardly therefrom.

The stamped rocker arm in accordance with the invention is designed to replace a cast rocker arm. Stamped rocker arms are less expensive to manufacture that cast ones, particularly when produced in larger quantities where die costs are spread out more. More importantly, stamped rocker arms are lighter in weight, often substantially lighter, which is an important advantage since lighter engines and vehicles result in better fuel economy and engine effiency or else in higher performance for the engines.

The rocker arm in accordance with the invention is made by cold-forming operations, including stamping, coining, staking, and back-packing. The new rocker arm includes a one-piece metal body which is of inverted U-shaped cross section throughout most of its length. The body has a top wall with two structurally-integral side walls depending therefrom. The rocker arm body includes a recess formed in a first end portion to receive an upper end of a push rod and a second end portion of the rocker arm body has means therein, either in the form of a roller or a pad, to engage an end of a valve stem. An intermediate portion of the body is rotatably mounted by bearings on a post which is affixed to the engine block.

In accordance with the invention, the side walls of the rocker arm body have annular flanges or hubs extending outwardly therefrom, being stamped or extruded in the side walls. The flanges form aligned bores which receive bearings, specifically the outer races thereof. The inner races of the bearings are cylindrical extensions which extend outwardly from a hub which is supported on the engine block.

Also in accordance with the invention, an oil port is formed in a top wall of the rocker arm body and communicates with a recess for the push rod. The port is positioned at an angle to direct oil upwardly over an intermediate portion of the rocker arm. A splash plate is formed by being bent upwardly from a portion of the top wall and is positioned in the path of the oil. The splash plate thereby disperses the oil more effectively over the rocker arms and other components. The splash plate preferably has openings therein to further enhance the dispersion of the oil.

It is, therefore, a principal object of the invention to provide a bearing-supported rocker arm which is cold-formed, and specifically stamped.

Another object of the invention is to provide a rocker arm with annular flanges in the side walls thereof to form bores for receiving support bearings.

Yet a further object of the invention is to provide a cold-formed rocker arm with a splash plate extending upwardly from the top wall thereof to disperse oil directed from an oil port in the rocker arm.

Other objects and advantages of the invention will be apparent from the following detailed description of preferred embodiments thereof, reference being made to the accompanying drawings, in which.

Figure 1:
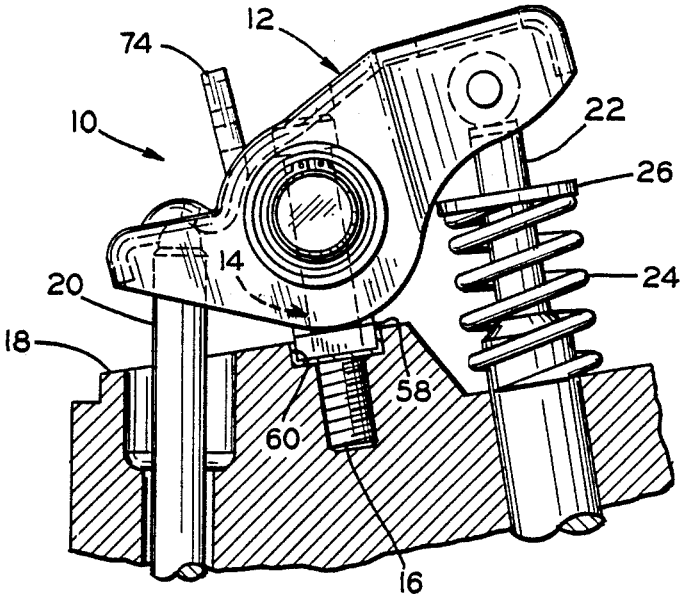
FIG. 1 is fragmentary, somewhat schematic side view in elevation of a rocker arm assembly in accordance with the invention, mounted on an engine which is shown in cross section.

Referring to the drawings, and particularly to FIG. 1, a rocker arm assembly in accordance with the invention is indicated at 10 and includes an elongate, cold-formed rocker arm 12 rotatably mounted on a supporting pedestal 14. A suitable threaded fastener or machine bolt 16 extends through a bore in the pedestal and mounts the assembly on a cylinder head 18 of an engine block. One end of the rocker arm 12 engages the upper end of a push rod 20 and the other end of the rocker arm engages the upper end of a valve stem 22. The valve stem extends upwardly from a valve (not shown) in the cylinder head and through a coiled compression spring 24 which is between the cylinder head 18 and a retaining ring 26 mounted on the valve stem.

Figure 2:
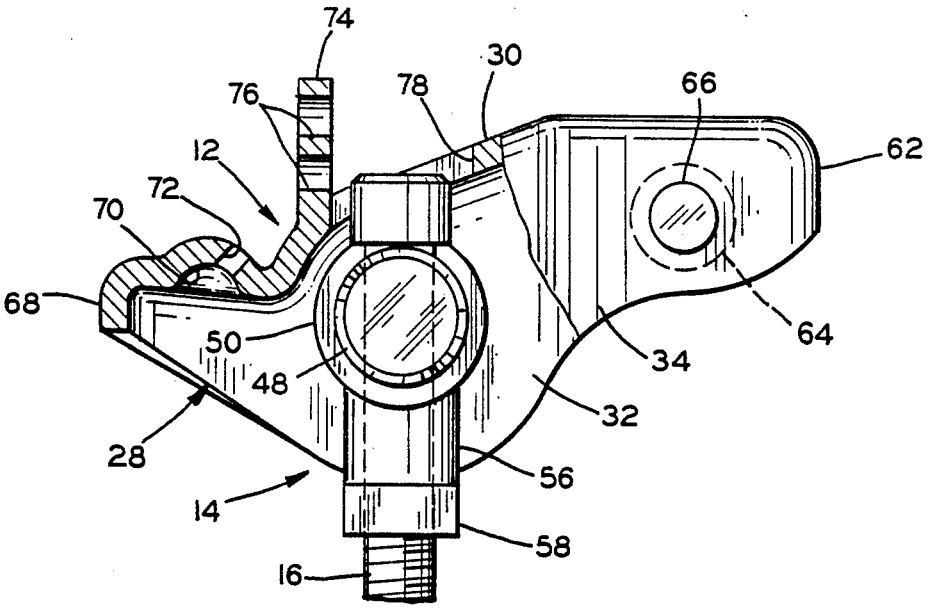
FIG. 2 is an enlarged side view of the rocker arm assembly shown in FIG. 1, with parts broken away and with parts in cross section.
Figure 3:
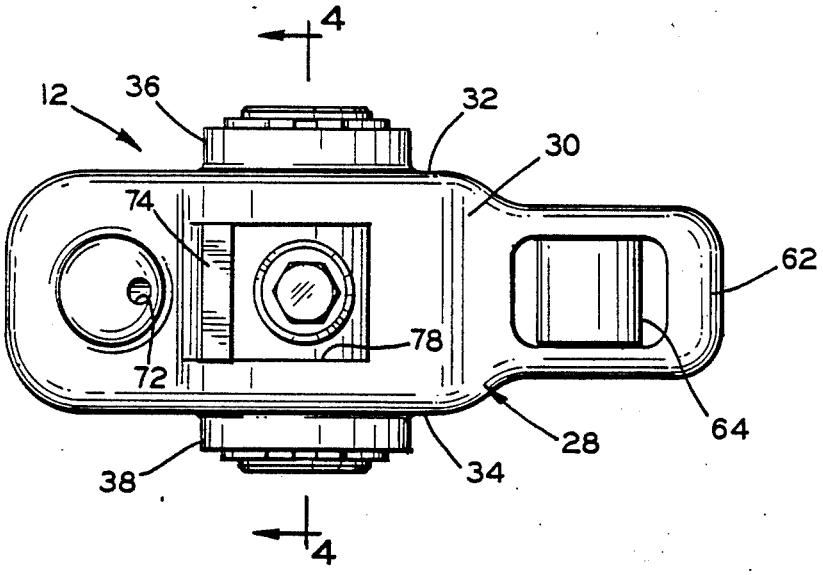
FIG. 3 is a top view of the rocker arm assembly.
Figure 4:
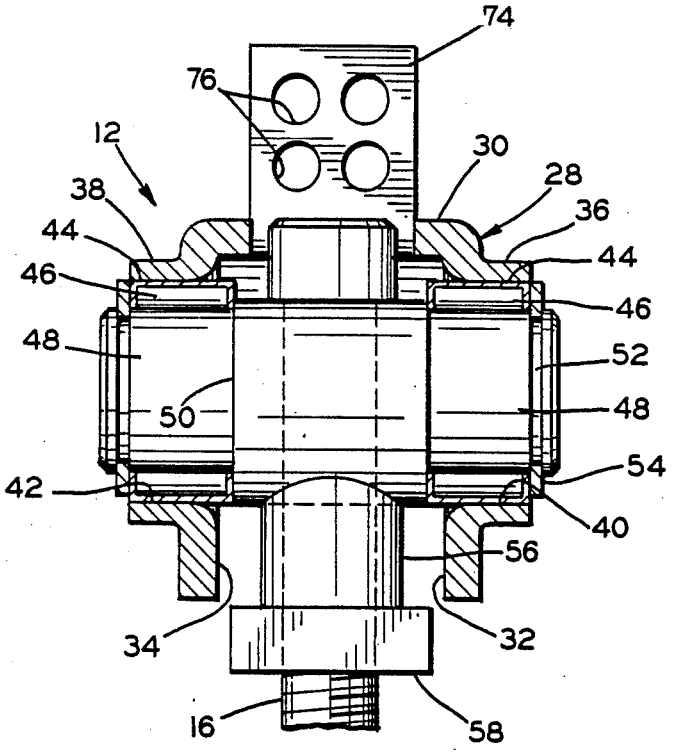
FIG. 4 is a view in transverse cross section taken along the line 4—4 of FIG. 3.

Referring to FIGS. 2–4, the rocker arm 12 includes a one-piece metal body 28 having a top wall 30 and two structurally-integral side walls 32 and 34 depending therefrom, and being in generally parallel relationship. The top wall 30 is narrower at one end and the side walls 32 and 34 are closer together at that end. However, the entire body 34 is of generally inverted U-shaped cross section throughout most of its length. Central portions of the side walls 30 and 32 have annular flanges or hubs 36 and 38 extending outwardly therefrom. These flanges are stamped or extruded from the side walls 32 and 34 and form aligned bores 40 and 42 (FIG. 4). Outer bearing races 44 are press fit in the bores 40 and 42 and retain rolling elements or needles 46. Cylindrical extensions 48, which extend outwardly from a hub 50, form inner races for the bearing elements. Ends of the inner races 48 have annular grooves 50 which hold suitable snap rings 54 which restrict axial movement of the outer races 44. A post 56 with an upper curved end fits closely with the lower periphery of the hub 50 and supports the rocker arm assembly above the upper surface of the engine block 18, the hub and post being held in assembled relationship by the machine bolt 16 and constituting the pedestal 14. The post 56 has a rectangular foot or flange 58 which is received in a trough element 60 in the engine block 18 as shown in the FIG. 1, in this instance, to retain the post 56 along with the remainder of the rocker arm assembly 10 in a given position.

Referring to FIG. 2 and 3, one end portion 62 of the rocker arm body 28 has means to engage the valve stem 22. In this instance, the means is in the form of a roller 64 having an axle 66 mounted in the side walls 32 and 34 of the rocker arm body. However,a pad with a convex surface facing downwardly could be used in place of the roller 64, as is known in the art. A particular means for engaging the upper end of valve stem 22 does not constitute a specific part of the invention.

Referring particularly to FIG.2, another end portion 68 of the rocker arm body 28 has means to engage the push rod 20. This is shown in the form of a generally semi-spherical, downwardly-facing recess 70 which fits over the rounded upper end of the push rod 20 and receives oil through the push rod. An oil port 72 is formed in the top wall 30 of the rocker arm body and communicates with the recess 70. The oil port is positioned to direct oil in a path toward a space above an intermediate portion of the rocker arm. An oil splash plate 74 extends upwardly from the top wall 30 and is located in the path of the oil directed from the port 72. The splash plate disperses the oil over a larger area of the rocker arms and other components to provide more effective lubrication. Preferably, the splashplate 74 has holes or openings 76 therein to further aid in the dispersion of oil. The splash plate 74 is located at an edge of a rectangular opening 78 in the top wall 30, the plate 74 being bent up from a plane of the top wall 30 to leave the opening 78.

From the above, it will be seen that the cold-formed, specifically stamped, rocker arm in accordance with the invention provides an effective substitute for cast arms. The stamped or extruded annular flanges or hubs are an important part of this design, providing effective means for holding the support bearings. The stamped splash plate also is relatively easily formed to enhance the dispersion of oil.

Various modifications of the above-described embodiments of the invention will be apparent to those skilled in the art, and it is to be understood that such modifications can be made without departing from the scope of the invention, if they are within the spirit and the tenor of the accompanying claims.

I claim:

1. A cold-formed rocker arm comprising a one-piece metal body of generally inverted U-shaped cross section throughout most of its length, said body having a top wall and two generally parallel side walls extending downwardly therefrom and being structurally integral therewith, said side walls having annular flanges extending outwardly therefrom and forming aligned bores to receive bearings, said body having means at one end to engage an end of a push rod, and said body having means at the other end to engage an end of a valve stem.

2. A cold-formed rocker arm according to claim 1 wherein said means at said one end is a downwardly-facing recess formed in said top wall to receive the end of the push rod.

3. A cold-formed rocker arm according to claim 2 wherein an oil port is formed in said top wall and communicates with said recess.

4. A cold-formed rocker arm according to claim 3 wherein said oil port slants upwardly and toward an intermediate portion of said rocker arm.

5. A cold-formed rocker arm according to claim 4 wherein said top wall has an upwardy-extending splash plate and said port is aligned with said splash plate.

6. A cold-formed rocker arm according to claim 5 wherein said splash plate has openings therein to aid in dispersing oil directed toward said splash plate through said port.

7. A rocker arm comprising a metal body having means at a central portion for receiving a support for pivotally supporting said body, said body having means at one end to engage a push rod and means at the other end to engage a valve stem, said body having port means at one end for directing oil upwardly over a central portion of said body, and said body having a splash plate extending upwardly with a portion thereof positioned to be in the path of oil from said port means.

8. A rocker arm according to claim 7 wherein said metal body has two generally parallel, spaced side walls, said side walls having annular flanges extending outwardly therefrom and forming aligned bores to receive bearings.

9. A rocker arm according to claim 7 wherein said means at one end of said body is a downwardly-facing recess to receive and end of the push rod.

10. A rocker arm according to claim 9 wherein said one end of said body has said port means communicating with said recess, with oil in said recess being directed through said port means toward said splash plate.

11. A cold-formed rocker arm comprising a one-piece metal body, said body having a top wall and two generally parallel side walls having structurally-integral annular flanges extending outwardly therefrom and forming aligned bores to receive bearings, said body having means at one end to engage a push rod, said body having means at the other end to engage a valve stem, said body having a splash plate extending upwardly from said top wall, said one end of said body having port means communicating with said means at the one end and positioned to direct oil toward said splash plate.

12. A rocker arm according to claim 11 wherein said means at the one end is a downwardly-facing recess, and said port means communicates with said recess.

13. A rocker arm according to claim 12 wherein said splash plate has openings therein to aid in dispersing oil directed through said port means.

14. In combination, a cold-formed rocker arm comprising a one-piece metal body of generally inverted U-shaped cross section throughout most of its length, said body having a top wall and two generally parallel side walls extending downwardly therefrom, said side walls having annular flanges extending outwardly, therefrom and forming aligned bores, said body having means at one end to engage a push rod, and said body having means at the other end to engage a valve stem, a supporting post with a central hub within said metal body, said hub having two cylindrical inner bearing races extending outwardly from opposite sides thereof, and bearing means around said cylindrical inner races and having outer races held by said annular flanges.

15. The combination according to claim 14 wherein said cylindrical inner races have means beyond said outer races to restrict said outer races from axial movement with respect to said inner races.

16. The combination according to claim 14 wherein said top wall has a rectangular opening therein with a splash plate being formed by a portion of said top wall which extends upwardly from one end of said opening.

17. The combination according to claim 16 wherein said means at one end is a downwardly-facing recess and said top wall has port means communicating with said recess.

18. The combination according to claim 17 wherein said splash plate has openings therein to aid in dispersing oil directed toward said splash plate from said port means.

19. The combination according to claim 17 wherein said splash plate extends upwardly from an end of said opening which is closer to said port means.

* * * * *

UNITED STATES PATENT AND TRADEMARK OFFICE

CERTIFICATE OF CORRECTION

PATENT NO. : 4,944,257

DATED : July 31, 1990

INVENTOR(S) : Jesse V. Mills

It is certified that error appears in the above-identified patent and that said Letters Patent is hereby corrected as shown below:

Abstract, line 7, change "extnding" to --extending--.

Column 3, line 7, change "splashplate" to --splash plate--.

Column 4, line 8, claim 9, line 3, change "and" to --an--.

Column 4, line 35, claim 14, line 6, delete ",".

Signed and Sealed this

Twenty-fourth Day of September, 1991

*Attest:*

HARRY F. MANBECK, JR.

*Attesting Officer*

*Commissioner of Patents and Trademarks*